US007856775B2

(12) United States Patent
Stahl, Jr.

(10) Patent No.: US 7,856,775 B2
(45) Date of Patent: Dec. 28, 2010

(54) THERMAL INSULATION AND SEALING MEANS FOR A SAFING SLOT

(75) Inventor: James P. Stahl, Jr., Princeton Junction, NJ (US)

(73) Assignee: Specified Technologies Inc., Somerville, NJ (US)

( * ) Notice: Subject to any disclaimer, the term of this patent is extended or adjusted under 35 U.S.C. 154(b) by 74 days.

(21) Appl. No.: 12/288,072

(22) Filed: Oct. 16, 2008

(65) Prior Publication Data

US 2009/0126297 A1 May 21, 2009

Related U.S. Application Data

(60) Provisional application No. 61/003,546, filed on Nov. 16, 2007.

(51) Int. Cl.

| | |
|---|---|
| ***E04B 1/92*** | (2006.01) |
| ***E04B 1/94*** | (2006.01) |
| *E04H 9/00* | (2006.01) |
| *E04H 9/14* | (2006.01) |

(52) U.S. Cl. ..... 52/232; 52/1; 52/573.1; 52/272

(58) Field of Classification Search ..... 52/1, 52/573.1, 232, 220.8, 272, 273, 278, 396.01, 52/402, 741.4

See application file for complete search history.

(56) References Cited

U.S. PATENT DOCUMENTS

| | | | | |
|---|---|---|---|---|
| 3,357,144 | A | 12/1967 | Chauyeau et al. | |
| 3,604,167 | A * | 9/1971 | Hays | 52/282.4 |
| 3,786,604 | A * | 1/1974 | Kramer | 52/232 |
| 3,936,986 | A * | 2/1976 | Steel | 52/235 |
| 3,950,906 | A | 4/1976 | Mollinger | |
| 3,968,608 | A | 7/1976 | Swango | |
| 3,978,629 | A | 9/1976 | Echols, Sr. | |
| 3,994,107 | A | 11/1976 | Aughuet | |
| 4,136,707 | A * | 1/1979 | Gaillot et al. | 137/75 |
| 4,221,095 | A | 9/1980 | Weinar | |
| 4,449,341 | A | 5/1984 | Taglianetti et al. | |
| 4,531,332 | A | 7/1985 | Gartner | |
| 4,543,755 | A | 10/1985 | Crandell | |
| 4,608,793 | A | 9/1986 | Yost et al. | |
| 4,610,115 | A | 9/1986 | Thompson, Jr. | |
| 4,614,069 | A | 9/1986 | Tanikawa et al. | |
| 4,633,631 | A | 1/1987 | Crandell | |
| 4,662,135 | A | 5/1987 | Tanikawa et al. | |

(Continued)

FOREIGN PATENT DOCUMENTS

JP 05302377 A * 11/1993

(Continued)

*Primary Examiner*—Brian E Glessner
*Assistant Examiner*—Joseph J Sadlon
(74) *Attorney, Agent, or Firm*—Sperry, Zoda & Kane

(57) ABSTRACT

A construction for effectively fireproof sealing of the gap between the floor of a building and an exterior wall construction wherein the exterior wall construction comprises a curtain wall configuration utilizing an interior panel module design. The insulating system includes a supplemental insulation belt positioned beneath the safing insulation and attached to the interior panel of a curtain wall construction to maintain sealing of the safing slot during exposure to fire and heat which can cause the interior panel to deform from heat warping to an extent beyond the capability of standard safing insulation for expanding in order to maintain a proper seal extending across the safing slot.

17 Claims, 2 Drawing Sheets

U.S. PATENT DOCUMENTS

| | | | | | |
|---|---|---|---|---|---|
| 4,662,136 | A | | 5/1987 | Tanikawa et al. | |
| 4,662,145 | A | | 5/1987 | Tanikawa et al. | |
| 4,738,065 | A | | 4/1988 | Crandell | |
| 4,758,003 | A | * | 7/1988 | Goldstein et al. | 277/314 |
| 4,811,529 | A | * | 3/1989 | Harris et al. | 52/396.01 |
| 4,873,805 | A | | 10/1989 | Ting | |
| 4,974,380 | A | | 12/1990 | Bernander et al. | |
| 5,351,448 | A | * | 10/1994 | Gohlke et al. | 52/1 |
| 5,355,645 | A | | 10/1994 | Farag | |
| 5,381,637 | A | | 1/1995 | Farag | |
| 5,502,937 | A | * | 4/1996 | Wilson | 52/273 |
| 5,765,332 | A | | 6/1998 | Landin et al. | |
| 5,913,788 | A | * | 6/1999 | Herren | 52/241 |
| 5,950,385 | A | | 9/1999 | Herren | |
| 5,974,750 | A | | 11/1999 | Landin et al. | |
| 6,058,668 | A | | 5/2000 | Herren | |
| 6,128,874 | A | | 10/2000 | Olson et al. | |
| 6,216,404 | B1 | * | 4/2001 | Vellrath | 52/232 |
| 6,253,510 | B1 | * | 7/2001 | Santarossa | 52/287.1 |
| 6,578,340 | B2 | | 6/2003 | Ishikawa et al. | |
| 6,658,804 | B2 | | 12/2003 | Leytes et al. | |
| 6,857,233 | B2 | | 2/2005 | Farag | |
| 7,240,905 | B1 | * | 7/2007 | Stahl, Sr. | 277/652 |
| 7,424,793 | B1 | * | 9/2008 | Shriver | 52/235 |
| 2004/0221518 | A1 | * | 11/2004 | Westra | 52/79.1 |

FOREIGN PATENT DOCUMENTS

| | | | | |
|---|---|---|---|---|
| JP | 06057844 | A | * | 3/1994 |
| JP | 06108553 | A | * | 4/1994 |

* cited by examiner

THERMAL INSULATION AND SEALING MEANS FOR A SAFING SLOT

The present utility application hereby formally claims priority of currently pending U.S. Provisional Patent application No. 61/003,546 filed Nov. 16, 2007 on "Curtain Wall Back Pan Safing Construction System" filed by the same inventor listed herein, namely, James P. Stahl, Jr., and said referenced provisional application is hereby formally incorporated by reference as an integral part of the present application.

BACKGROUND OF THE INVENTION

1. Field of the Invention

The present invention deals with the field of constructions and systems designed to seal between a curtain wall and the individual floors of a building. This area is commonly called a safing slot area and the present invention is useful specifically with those types of curtain walls which include a interior panel such as an back pan or other similar construction which can be of metal or other material extending across the interior surface which is common in modular designs. Such interior panels are commonly made from a metal or insulation material which can easily warp or be otherwise be deformed when exposed to the amount of heat commonly experienced in a burning environment. Flexing or warping of these interior panels can present significant problems in attempting to maintain a complete seal within the safing slots between the exterior edges of the floor construction and the exterior curtain wall construction during a fire. Maintaining of a complete seal at all time during a fire is important to prevent heat, smoke and flames from traveling from one floor to an adjacent floor.

2. Description of the Prior Art

Various designs have been patented for curtain walls and for means for insulating in the safing slots such as shown in U.S. Pat. No. 3,357,144 patented Dec. 12, 1967 to P. A. Chauveau et al and assigned to Constructions Metalliques Fillod S. A. on an "External Sheathing or Curtain Wall"; and U.S. Pat. No. 3,950,906 patented Apr. 20, 1976 to S. Mollinger on a "Flexible Curtain Wall"; and U.S. Pat. No. 3,968,608 patented Jul. 13, 1976 to B. J. Swango on a "Curtain Wall Panel Support"; and U.S. Pat. No. 3,978,629 patented Sep. 7, 1976 to C. W. Echols, Sr. and assigned to The Wilkliam L. Bonnell Company on a "Thermal Barrier Curtain Wall"; and U.S. Pat. No. 3,994,107 patented Nov. 30, 1976 to A. A. Aughuet and assigned to Application de la Chimie, de l'Electricite et des Metaux, en abregen "SADACEM" on a "Curtain Wall Structure"; and U.S. Pat. No. 4,221,095 patented Sep. 9, 1980 to R. N. Weinar on a "Wall Constructed From Wallboard Held Together With Concealed Fasteners"; and U.S. Pat. No. 4,449,341 patented May 22, 19084 to P. C. Taglianetti et al and assigned to PPG Industries, Inc. on a "Fire Containment Arrangement For Curtain Wall Construction"; and U.S. Pat. No. 4,531,332 patented Jul. 30, 1985 to K. Gartner and assigned to Yoshida Kogyo K. K. on a "Rooftop Parapet For Thermally-Insulated Curtain Wall"; and U.S. Pat. No. 4,543,755 patented Oct. 1, 1985 to S. L. Crandell and assigned to PPG Industries, Inc. on a "Curtainwall System"; and U.S. Pat. No. 4,608,793 patented Sep. 2, 1986 to W. R. Yost et al and assigned to Cadillac Rubber & Plastics, Inc. on a "Structural Gasket Wall"; and U.S. Pat. No. 4,610,115 patented Sep. 9, 1986 to A. E. Thompson, Jr. and assigned to PPG Industries, Inc. on a "Multiple-Glazed Combination Vision And Spandrel Architectural Panel And Curtainwall"; and U.S. Pat. No. 4,614,069 patented Sep. 30, 1986 to S. Tanikawa et al and assigned to Yoshida Kogyo K. K. on a "Prefabricated Curtain Wall Assembly"; and U.S. Pat. No. 4,633,631 patented Jan. 6, 1987 to S. L. Crandell and assigned to PPG Industries, Inc. on a "Curtainwall System"; and U.S. Pat. No. 4,662,135 patented May 5, 1987 to S. Tanikawa et al and assigned to Yoshida Kogyo K. K. on a "Device For Mounting A Prefabricating Curtain Wall Unit To A Floor Structure"; and U.S. Pat. No. 4,662,136 patented May 5, 1987 to S. Tanikawa et al and assigned to Yoshida Kogyo K. K. on a "Prefabricated Curtain Wall Assembly Having Both Window And Spandrel Units"; and U.S. Pat. No. 4,662,145 patented May 5, 1987 to S. Tanikawa et al and assigned to Yoshida Kogyo K. K. on a "Prefabricated Curtain Wall Assembly Having Both Window And Spandrel Units, And Method Of Installation"; and U.S. Pat. No. 4,738,065 patented Apr. 19, 1988 to S. L. Crandell and assigned to PPG Industries, Inc. on a "Curtainwall System"; and U.S. Pat. No. 4,873,805 patented Oct. 17, 1989 to R. M. L. Ting on a "Connecting Means Of Curtainwall Supporting Mullions"; and U.S. Pat. No. 4,974,380 patented Dec. 4, 1990 to K. G. Bernander et al on a "Framing For Structural Walls In Multistory Buildings"; and U.S. Pat. No. 5,355,645 patented Oct. 18, 1994 to F. A. Farag on "Stopless Butt-Joint Multiple Curtainwall System"; and U.S. Pat. No. 5,381,637 patented Jan. 17, 1995 to F. A. Farag on a "Stopless Butt-Joint Curtainwall System"; and U.S. Pat. No. 5,502,937 patented Apr. 2, 1996 to V. H. Wilson and assigned to Minnesota Mining And Manufacturing Company on a "Fire Protective Flexible Composite Insulating System"; and U.S. Pat. No. 5,765,332 patented Jun. 16, 1998 to H. V. Landin et al and assigned to Minnesota Mining And Manufacturing Company on a "Fire Barrier Protected Dynamic Joint"; and U.S. Pat. No. 5,913,788 patented Jun. 22, 1999 to T. R. Herren on a "Fire Blocking And Seismic Resistant Wall Structure"; and U.S. Pat. No. 5,950,385 patented Sep. 14, 1999 to T. R. Herren on an "Interior Shaft Wall Construction"; and U.S. Pat. No. 5,974,750 patented Nov. 2, 1999 to H. V. Landin et al and assigned to 3M Innovative Properties Company on a "Fire Barrier Protected Dynamic Joint"; and U.S. Pat. No. 6,058,668 patented to T. R. Herren on May 9, 2000 on a "Seismic And Fire-Resistant Head-Of-Wall Structure"; and U.S. Pat. No. 6,128,874 patented Oct. 10, 2000 to J. R. Olson et al and assigned to Unifrax Corporation and Construction Specialties, Inc. on a "Fire Resistant Barrier For Dynamic Expansion Joints"; and U.S. Pat. No. 6,578,340 patented Jun. 17, 2003 to M. Ishikawa et al and assigned to YKK Corporation on a "Wall Structure Of Building"; and U.S. Pat. No. 6,658,804 patented Dec. 9, 2003 to V. S. Leytes et al on a "Self-Bearing Flexible Curtain Wall System"; and U.S. Pat. No. 6,857,233 patented Feb. 22, 2005 to F. A. Farag on a "Fire Resistant Rated Fenestration, Including Curtain Wall Systems, For Multiple Story Buildings".

SUMMARY OF THE INVENTION

The present invention provides a thermal insulating and sealing construction for effectively thermally insulating and sealing of the safing slot within building construction designed specifically for those utilizing the curtain wall construction configuration. Such structures include interior panels preferably of metal or other materials such as insulation but can be of any shape or chosen material which would extend over the interior surface thereof. One or more floors are positioned within the building such as to define the safing slot extending between the interior surface of an interior panel and the outer edge of the floor. The improvement in the thermal insulating and sealing means of the present invention includes a primary insulation formed of thermal resistant material which is preferably flexibly compressive such as mineral wool which can be positioned within a safing slot defined in the building construction. The safing slot is defined between the outer edge of the floor and the inner surface of an interior panel such as a metal back pan which extends over the inner surface of the curtain wall construction. The safing insulation is designed to thermally insulate and seal the safing slot defined in this area.

This primary insulation preferably includes an inner primary end surface positionable in abutment with respect to the outer edge of a floor for sealing thereadjacent. Furthermore the primary insulation includes an outer primary end surface positionable in abutment with respect to the interior panel of the curtain wall and, preferably, attached to the interior surface of the interior curtain wall panel. Furthermore, the primary insulation will define a lower primary facing surface extending between the inner primary end surface and the outer primary end surface and facing downwardly therebetween.

The safing insulation construction of the present invention further includes a supplemental insulation of thermally resistant material preferably being a flexible material such as mineral wool which is attached to the interior panel of a curtain wall at a position immediately below the primary insulation. This supplemental insulation is positioned in abutment with respect to the lower primary facing surface of the primary insulation. The supplemental insulation is, preferably, attached to the interior panel of the curtain wall construction and extends across the safing slot toward the outer edge of the floor thereadjacent, preferably, without being attached thereto. The supplemental insulation can comprise a band of such supplemental insulation extending longitudinally along and in abutment with respect to the lower primary facing surface of the primary insulation.

A supplemental attachment device may also be included for attaching of the supplemental insulation with respect to the curtain wall interior panel positioned thereadjacent. This supplemental attachment construction can include one or more weld pins extending through the supplemental insulation and attached to the interior surface of the curtain wall interior panel. Furthermore the supplemental attachment construction can include at least one cap nut secured to each of the pins adjacent to the supplemental insulation at a position oppositely disposed from the interior panel for the purpose of facilitating attachment of the supplemental insulation with respect to the interior surface of the curtain wall interior panel at a position immediately below the primary insulation and in abutment with respect to the lower primary facing surface thereof.

Optionally the construction of the present invention can include an outer fire retardant coating positioned extending across the primary insulation and adjacent portions of the interior curtain wall panel and the floor located thereadjacent. Such outer fire retardant coatings are normally applied by spraying or other similar means of application.

It is an object of the thermal insulation and sealing means for sealing between the edge of a floor and an interior panel of the present invention to maintain safing insulation between the floors of a residential or commercial building and the exterior curtain wall responsive to various conditions including fire exposure.

It is an object of the thermal insulation and sealing means for sealing between the edge of a floor and an interior panel of the present invention to maintain sealing of the safing slots surrounding the floor of each level in a building despite deforming of the interior panels especially those back pans made of various materials such as metal or the like which are positioned extending across the interior expanse of the curtain walls.

It is an object of the thermal insulation and sealing means for sealing between the edge of a floor and an interior panel of the present invention to provide a means for supplementing the safing insulation surrounding the floors of a building by abutment with the undersurface thereof by a supplemental belt of insulation which is attached to the interior surface of the interior panel of a modular curtain wall construction.

It is an object of the thermal insulation and sealing means for sealing between the edge of a floor and an interior panel of the present invention to maximize safing insulation at a minimal cost.

BRIEF DESCRIPTION OF THE DRAWINGS

While the invention is particularly pointed out and distinctly described herein, a preferred embodiment is set forth in the following detailed description which may be best understood when read in connection with the accompanying drawings, in which.

DETAILED DESCRIPTION OF THE PREFERRED EMBODIMENT

Figure 2:
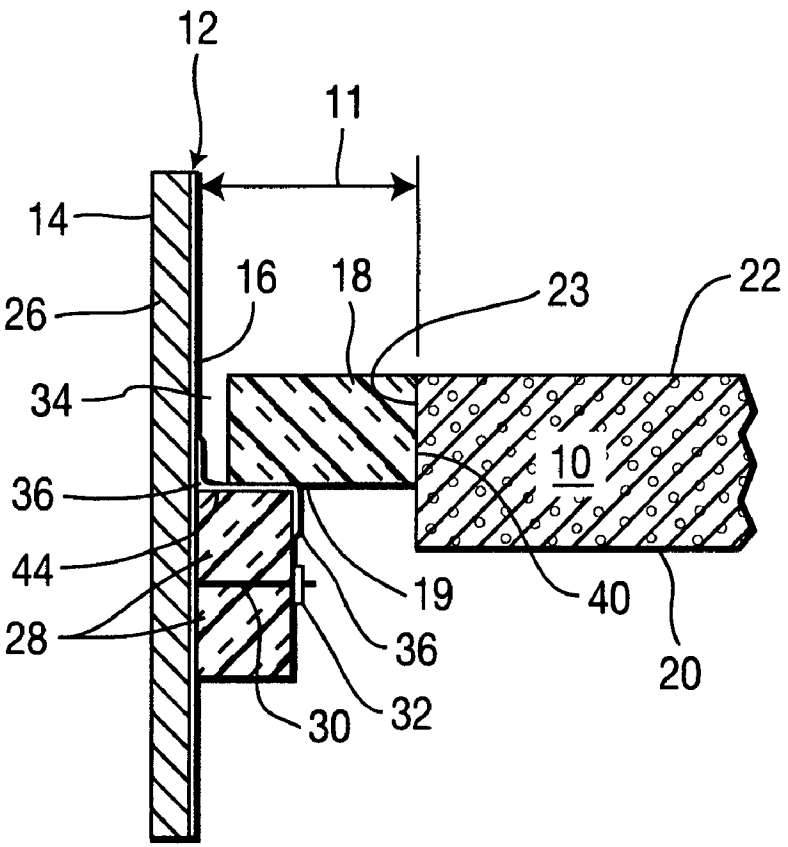
FIG. 2 is a side cross-sectional view of the embodiment shown in FIG. 1 after exposure to a fire which causes deforming of the interior curtain wall panel and the creation of an unwanted safing gap opening within the safing slots.

The curtain wall back pan safing insulation means of the present invention is designed for the purpose of facilitating firestopping of a safing slot 11 present in those buildings utilizing curtain wall structures 12 for the exterior cladding thereof which includes interior panels 16 such as back pans often made of materials that can deform responsive to exposure to heat. Such interior panels 16 generally are made of a metal, normally steel, material but can of any material such as aluminum clad insulation and merely insulating material itself. Most materials used for such interior panels 16 will deform responsive to exposure to heat. The interior panels 16 are normally positioned extending across the interior expanse of such curtain walls 12. The use of interior panels 16 such back pans are common presently with modular or pre-constructed curtain wall constructions 12.

A curtain wall structure 12 is a type of exterior wall system commonly utilized on buildings wherein the curtain wall itself is a non-bearing wall. Such curtain walls 12 generally are of a relatively lightweight material and commonly include brass or metal skins. This type of construction is normally used in high-rise buildings for providing a relatively lightweight and inexpensive overall construction.

Spandrel panels 14 are included in the curtain wall structure 12 to provide the exterior facing thereof and such panels are commonly made of glass, aluminum, thin sheets of foam material and the like. One particular type of unitized wall structure which is often used in modular constructions includes an interior panel 16 comprising a metallic sheet extending across the internal membrane and this metal sheet is referred to as the back pan. Such curtain wall systems commonly include vertical framing members comprising boxed aluminum channels referred to as mullions 24 and similarly configured horizontally extending pieces as referred to as transoms. The interior panels 16 of curtain wall constructions can be made of many materials and many of these materials are susceptible to warping responsive to high heat conditions. Some of these panels are of made from metallic materials but other non-metallic materials can also be used for this internal panel which are also capable of warping such as insulation and aluminum clad insulation and many other materials.

Each individual floor 10 within the building is normally spaced from the interior surface of the curtain wall structure 12 at a predefined distance which is commonly referred to as the safing slot 11. It is common to fireproof such safing slots 11 by utilizing safing insulation 18 which often uses compressed mineral wool or other similar insulating material to effectively seal these slots 11 to prevent fire, heat and flame from traveling from floor to adjacent floor in a building. When initially placed in the safing slot 11, this mineral wool safing insulation 18 is compressed somewhat. After positioned in the safing slot 11 the mineral wool materials is allowed to expand to effectively provide fireproof sealing of the slot 11. Because the mineral wool is compressed when installed, it does provide some capability to expand which can be used to seal openings that might develop in the safing slot 11. Slight variations in the size of the safing slot 11 due to some expansion or other environmental changes are accommodated by the safing insulation 18 since it is compressed when placed in the slot 11 and in this manner an effective seal is maintained under various conditions.

The primary safing insulation 18 is defined to include an inner primary end surface positionable in abutment with the outer edge 23 of floor 10. Insulation 18 also includes an outer primary end surface 42 positionable in abutment with respect to an interior panel 16. A lower primary facing surface is defined extending therebetween and facing downwardly. It is important that insulation is provided between the edge 23 of the floor 10 and the curtain wall 12 in such a manner that the insulation extends from the floor 10 at a position between the upper floor surface 22 and the lower floor surface 20. The common placement of insulation 18 is such that the inner primary end surface 40 abuts the outer edge 23 of the floor 10 and extends outwardly such that the outer primary end surface 42 is positioned in full abutting contact with respect to the interior panel 16 of the curtain wall structure 12. The normal curtain wall structure 12 includes wall insulation 26 positioned therewithin which provides some level of heat insulation and fireproofing within the basic curtain wall construction. The present invention deals specifically with a means for effectively creating a continuous fireproofing seal extending from the outermost edge 23 of the floor 10 to the curtain wall structure 12 and, in particular, to abutment with the interior panel 16 extending across the curtain wall surface.

Figure 4:
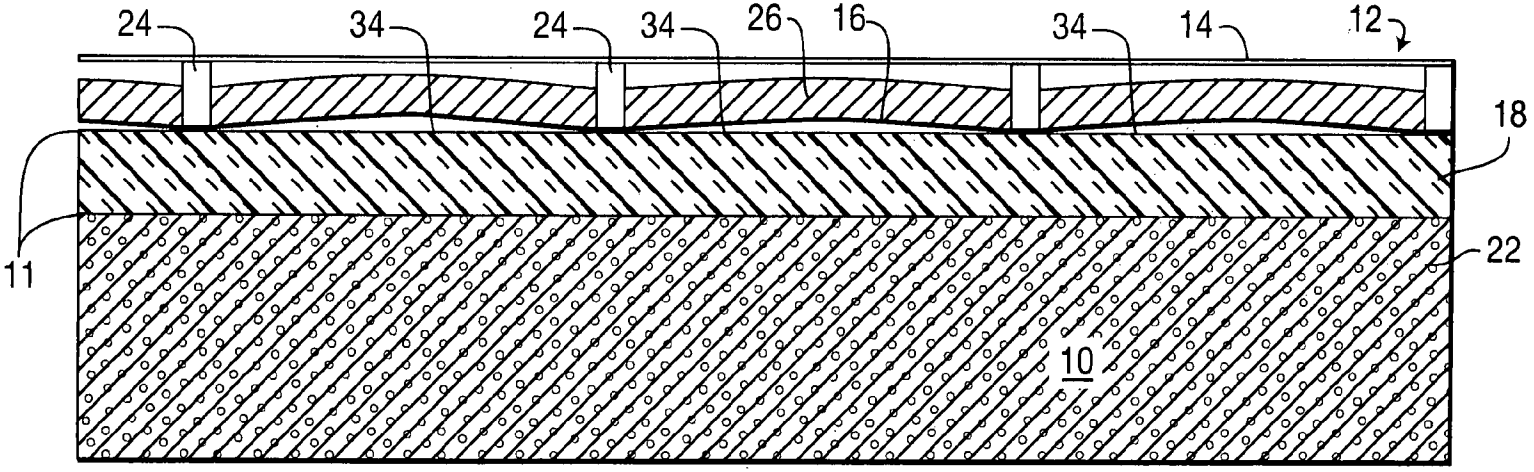
FIG. 4 is a top cross-sectional view of the embodiment shown in FIG. 2 after exposure to fire or heat conditions causing deformation such as warping of the interior panel of a curtain wall construction.

The sealing of this safing slot 11 is significantly complicated when utilizing such a interior panel 16 because the expansive size of such panels 16 can cause them to commonly deform and thus create openings or voids in insulation in the safing slot responsive to the heat of a fife. These interior panels 16 can be made of many different materials but currently they are commonly made of a metallic material such as steel or aluminum covered insulation or only insulating material. Such interior panels 16 they to deform responsive to heating such as during a fire regardless of the particular material from which they are made. But it should be appreciated that interior panels 16 that are metal such as those made of steel tend to deform significantly responsive to the heat of a fire. This heating and resulting deforming of any interior panel can cause an unwanted safing gap opening 34 to develop between the safing insulation 18 and the contorted or otherwise deformed interior panel 16. A view of the positioning of an example of such an unwanted safing gap opening 34 is shown in horizontal cross section in FIG. 2 and in vertical cross section in FIG. 4. FIG. 4 also shows the configuration of the interior panel 16 when deformed responsive to heat under the conditions of a fire. As shown in FIG. 4 the interior panels 16 are often deformed from a planar surface to arcuate or irregular surfaces thus opening up the unwanted safing gap opening 34 between the interior surface of the deformed interior panel 16 and the outermost edge of the sating insulation 18.

When installed, safing insulation 18 is commonly compressed to varying degrees, but normally it is compressed to approximately 25%. This compression will cause the safing insulation 18 to exert a force outwardly against the curtain wall 16. The interior panels 16 tend to deform responsive to heat by moving generally outwardly away from the safing slot 11. Because the safing insulation 18 is compressed into position, it has the capability to expand outwardly to fill these voids created in the safing insulation 18 responsive to deforming of the curtain wall 16. Thus if a curtain wall deforms outwardly by 25% of the lateral dimension of the safing insulation 18, then the insulation 18 will be capable of filling that void if it was initially installed with 25% compression. In this manner the compression of the safing insulation 16 will be able to maintain the safing seal complete responsive to this limited amount of deforming of the interior panel 16. However, when the deforming of the interior panel 16 is so extensive that it is greater than the horizontal distance into which the safing insulation 18 is capable of expanding, then a safing gap opening 34 results as shown in FIGS. 2 and 4 and this is certainly a dangerous and unwanted condition.

Figure 1:
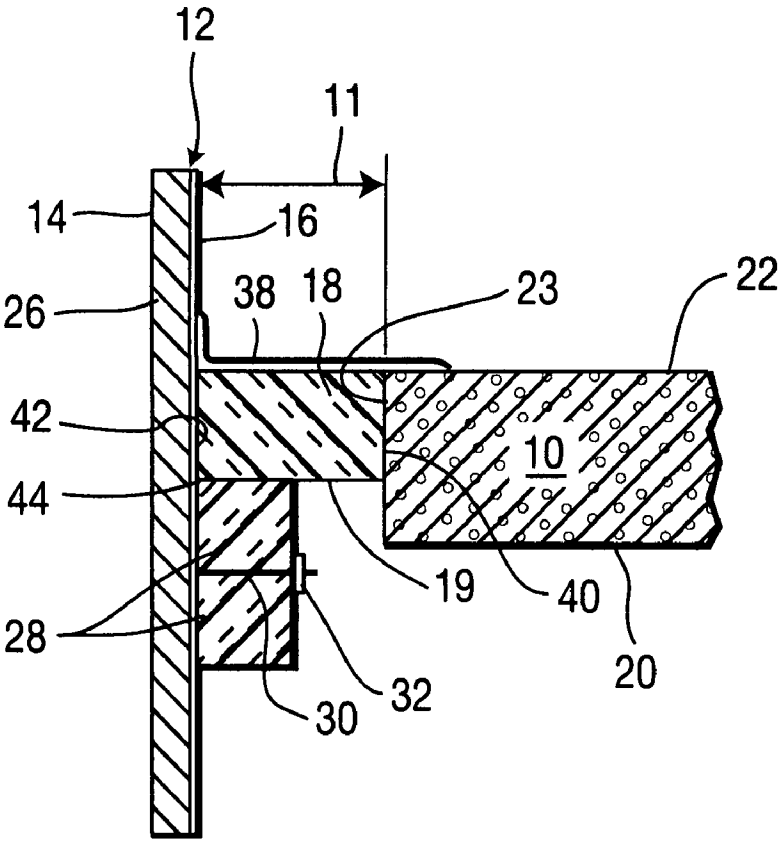
FIG. 1 is a side cross-sectional view of an embodiment of the thermal insulation and sealing means for sealing between the edge of a floor and an interior curtain wall panel of the present invention shown when initially installed.
Figure 3:
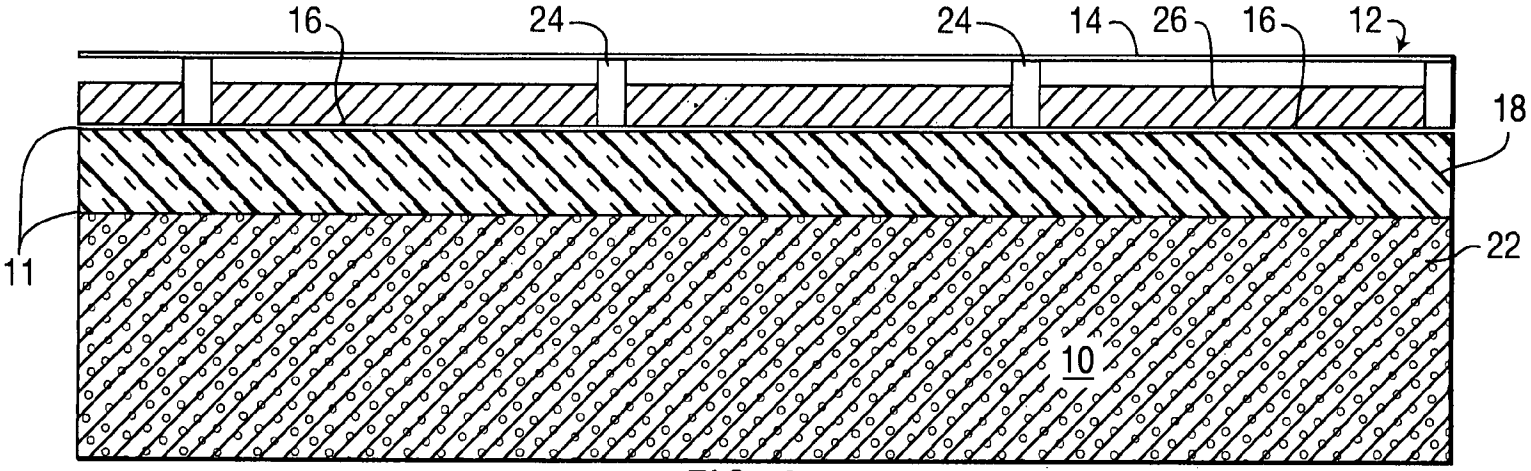
FIG. 3 is a top cross-sectional view of the embodiment shown in FIG. 1.

To maintain sealing of the safing slot 11 in those conditions where an interior panel 16 has expanded beyond the lateral expansion capability of the safing insulation 18, the present invention includes a supplemental insulation belt 28 to maintain a complete seal extending within the safing slot 11. Supplemental insulation belt 28 is shown best in FIG. 1 in the initially installed position. The supplemental insulation belt 28 extends horizontally along the interior panel 16 and is attached to the interior panel preferably by weld pins 30 and cap nuts 32 in such a manner as to be movable along any movement of the interior panel 16 such as when it deforms. It should be appreciated that many means of attachment to the interior panel could be utilized. Preferably this supplemental insulation belt 28 will be positioned in abutting contact with respect to the lower primary facing surface 19 of the safing insulation 18. To further assure maintaining of abutment the supplemental insulation belt 28 can be initially installed some compression thereof against lower surface 19 of the safing insulation 18. Normally the safing insulation 18 is attached to the outer edge 23 of the floor 10. There is no specific means of attachment between the upper surface of the supplemental insulation belt 28 and the lower surface 19 of the safing insulation 18 and, as such, these two surfaces can laterally slide along one another while maintaining abutting contact therebetween. This sliding relative movement would occur responsive to deforming of the interior panel 16 since the supplemental insulation belt 28 is attached thereto.

As such, with this embodiment it should be considered that the safing insulation 18 is attached to the outer edge 23 of floor 10 and the supplemental insulation belt 28 is attached to the interior panel 16. Thus, as the interior panel 16 distorts or deforms, a safing gap opening 34 will be created between the safing insulation 18 and the interior panel 16 as shown best in FIGS. 2 and 4. However, because the supplemental insulation belt 28 is maintained in abutment with respect to the lower surface of the safing insulation 18, a complete seal extending across the entire safing slot 11 will be maintained. The lateral dimension of the supplemental insulation belt 28 can be varied significantly to accommodate various configurations of different interior panels 16 and safing slots 11 in order to accommodate and effective seal any such safing slot 11.

It should be appreciate that this embodiment of the present invention will work with many different types of insulating materials used for the safing insulation 18 and/or the supplemental insulation belt 28 as long as the material has effective high temperature insulating characteristics. It is also preferably but not required that the chosen insulating material be somewhat capable of compression. One of the best examples for material used for this purpose is mineral wool.

The sealing characteristics of the construction shown in the present invention is significantly enhanced by the application of coatings of fire retardant material. This fire retardant material can be applied such as by spraying or the like across the primary safing insulation 18 and the adjacent areas of the interior panel 16 and floor 10 as shown best in FIG. 1. Alternatively, or additionally, fire retardant material can be applied such as by spraying or the like and across the supplemental insulation 28 and the adjacent areas of the interior panel 16 as shown best in FIG. 2. FIG. 2 shows an inner fire retardant coating 36 extending over the upper edge of the supplemental insulation belt means 28 and the portion of the backpan 16 thereadjacent for facilitating sealing therebetween. Similarly, FIG. 2 shows an outer fire retardant coating 38 extending over the upper edge of the primary safing insulation 28 and the portion of the backpan 16 thereadjacent and the upper portion of the floor 10 thereadjacent for facilitating sealing the intersections between these parts.

The primary safing insulation 18 preferably extends from the upper surface 22 of floor 10 to an intermediate position 44 defined downwardly within said safing slot 11 at a point below the upper floor surface 22 and above the lower floor surface 20. The supplemental insulation 28 is preferably positioned in abutment with respect to said lower primary facing surface 19 at the intermediate position 44 within the safing slot 11, and the supplemental insulation means 28 will extend downwardly therefrom to a position below the safing slot 11.

As such, the apparatus of the present invention provides a means for effectively maintaining a complete seal in a safing slot 11 when utilizing modular curtain wall constructions 12 which include interior panels 16 extending across the interior surface thereof as is commonly utilized currently for modular or prefabricated designs.

While particular embodiments of this invention have been shown in the drawings and described above, it will be apparent that many changes may be made in the form, arrangement and positioning of the various elements of the combination. In consideration thereof, it should be understood that preferred embodiments of this invention disclosed herein are intended to be illustrative only and not intended to limit the scope of the invention.

I claim:

1. A building construction having a wall construction defining an interior wall surface, which includes an interior panel defining an interior panel surface and at least one floor defining an outer edge thereon spatially disposed from the interior wall surface to define a safing slot extending between the interior surface of the interior panel and the outer edge of the floor, wherein the improvement comprises a thermal insulating and sealing means for effectively thermally insulating and sealing of the safing slot comprising:

A. a primary insulation of thermally resistant material positioned in the safing slot defined between the outer edge of the floor and the interior panel extending over the interior surface of the wall construction to thermally insulate and seal the safing slot defined therebetween, said primary insulation including;

(1) an inner primary end surface positioned in abutment with the outer edge of the floor for sealing thereadjacent;

(2) an outer primary end surface positioned in abutment with the interior panel extending over the interior surface of the wall construction;

(3) a lower primary facing surface extending between said inner primary end surface and said outer primary end surface and facing downwardly therebetween;

B. a supplemental insulation of thermally resistant material attached to the interior panel of the wall at a position immediately below said primary insulation and in abutment with said lower primary facing surface thereof, said supplemental insulation being movable along with the interior panel of the wall to maintain insulation in abutment therewith and to facilitate maintaining complete insulation across the safing slot; and C. a supplemental attachment means for attaching of said supplemental insulation to the interior panel positioned thereadjacent to facilitate movement of said supplemental insulation along with the interior panel of the wall and maintain insulation thereadjacent for extending completely across the safing slot.

2. The improved thermal insulation and sealing means for effectively thermally insulating and sealing of a safing slot as defined in claim 1 wherein said primary insulation and said supplemental insulation each comprise thermally resistant flexible material to facilitate placement thereof into the sating slot adjacent one another.

3. The improved thermal insulation and sealing means for effectively thermally insulating and sealing of a safing slot as defined in claim 1 wherein said primary insulation and said supplemental insulation each comprise thermally resistant flexible mineral wool material to facilitate placement thereof into the safing slot adjacent one another.

4. The improved thermal insulation and sealing means for effectively thermally insulating and sealing of a safing slot as defined in claim 1 wherein said outer primary end surface of said primary insulation is initially positioned in abutting contact with and unattached to the interior surface of the adjacent interior panel.

5. The improved thermal insulation and sealing means for effectively thermally insulating and sealing of a safing slot as defined in claim 1 wherein said supplemental insulation is positioned in abutment with said lower primary facing surface of said primary insulation within the sating slot and is attached to the interior panel and extends across the safing slot toward the outer edge of the floor thereadjacent without being attached thereto.

6. The improved thermal insulation and sealing means for effectively thermally insulating and sealing of a safing slot as defined in claim 1 wherein said supplemental attachment means comprises:

A. at least one pin extending through said supplemental insulation and being attached to the interior surface of the interior panel; and B. at least one nut secured to each of said pins adjacent said supplemental insulation at a position oppositely disposed from the interior surface of the interior panel for facilitating attachment of said supplemental insulation to the interior surface of the interior panel immediately below said primary insulation and in abutment with said lower primary facing surface thereof.

7. The improved thermal insulation and sealing means for effectively thermally insulating and sealing of a safing slot as defined in claim 6 wherein each said pin comprises a weld pin and wherein each said nut comprises a cap nut.

8. The improved thermal insulation and sealing means for effectively thermally insulating and sealing of a safing slot as defined in claim 1 wherein said supplemental insulation comprises a band of supplemental insulation extending longitudinally along and in abutment with said lower primary facing surface of said primary insulation.

9. The improved thermal insulation and sealing means for effectively thermally insulating and sealing of a safing slot as defined in claim 1 wherein said supplemental insulation is initially compressed against said lower primary facing surface of said primary insulation when attached to the interior panel adjacent said lower primary facing surface to facilitate maintaining of abutment therewith responsive to thermal deforming movement of the interior panel.

10. The improved thermal insulation and sealing means for effectively thermally insulating and sealing of a safing slot as defined in claim 1 further comprising an outer fire retardant coating placed across said primary insulation means and the adjacent portions of the interior panel and the floor located thereadjacent.

11. The improved thermal insulation and sealing means for effectively thermally insulating and sealing of a safing slot as defined in claim 1 further comprising an inner fire retardant coating placed across said supplemental insulation means and the adjacent portions of the interior panel and the floor located thereadjacent.

12. The improved thermal insulation and sealing means for effectively thermally insulating and sealing of a safing slot as defined in claim 1 wherein said supplemental insulation of thermally resistant material is attached to the interior panel of the wall at a position immediately below said primary insulation and in abutment with said lower primary facing surface thereof and wherein said supplemental insulation extends outwardly from said interior panel toward the outer edge of the floor.

13. The improved thermal insulation and sealing means for effectively thermally insulating and sealing of a safing slot as defined in claim 12 wherein said supplemental insulation extends outwardly from the interior panel toward the outer edge of the floor to a position below said primary insulation at a position spatially disposed from the outer edge of the floor thereadjacent.

14. The improved thermal insulation and sealing means for effectively thermally insulating and sealing of a safing slot as defined in claim 1 wherein said primary insulation is in direct abutting engagement with respect to the outer edge of the adjacent floor and is positioned extending from the upper surface thereof of to an intermediate position defined downwardly therealong within said safing slot.

15. The improved thermal insulation and sealing means for effectively thermally insulating and sealing of a safing slot as defined in claim 14 wherein said supplemental insulation is positioned in abutment with said lower primary facing surface at said intermediate position within the safing slot, and wherein said supplemental insulation extends downwardly from said intermediate position to a position below the safing slot.

16. A building construction having a curtain wall construction defining an interior wall surface, which includes an interior panel defining an interior panel surface and at least one floor defining an outer edge thereon spatially disposed from the interior wall surface to define a safing slot extending between the interior surface of the interior panel and the outer edge of the floor, wherein the improvement comprises a thermal insulating and sealing means for effectively thermally insulating and sealing of the safing slot comprising:

A. a primary insulation of thermally resistant flexible material positioned in the safing slot defined between the outer edge of the floor and the interior panel extending over the interior surface of the curtain wall construction to thermally insulate and seal the sating slot defined therebetween, said primary insulation including;

(1) an inner primary end surface positioned in abutment with the outer edge of the floor for sealing thereadjacent;

(2) an outer primary end surface positioned in abutment with respect to the interior panel extending over the interior surface of the curtain wall construction and unattached to the interior surface of the adjacent interior panel;

(3) a lower primary facing surface extending between said inner primary end surface and said outer primary end surface and facing downwardly therebetween;

B. a supplemental insulation of thermally resistant flexible material attached to the interior panel of the curtain wall at a position immediately below said primary insulation and in abutment with said lower primary facing surface thereof, said supplemental insulation being attached to the interior panel and extending across the safing slot toward the outer edge of the floor thereadjacent without being attached thereto, said supplemental insulation being movable along with the interior panel of the wall to maintain insulation in abutment therewith and to facilitate maintaining complete insulation across the safing slot;

C. a supplemental attachment means for attaching of said supplemental insulation to the interior panel positioned thereadjacent to facilitate movement of said supplemental insulation means along with the interior panel of the wall and maintain insulation thereadjacent for extending completely across the sating slot, said supplemental attachment means comprising:

(1) at least one pin extending through said supplemental insulation and being attached to the interior surface of the interior panel;

(2) at least one nut secured to each of said pin adjacent said supplemental insulation at a position remotely positioned from the interior surface of the interior panel for facilitating attachment of said supplemental insulation to the interior surface of the interior panel immediately below said primary insulation and in abutment with said lower primary facing surface thereof;

D. a outer fire retardant coating positioned extending across said primary insulation and the adjacent portions of the interior panel and the floor located thereadjacent.

17. A building construction having a curtain wall construction defining an interior wall surface, which includes a metal interior panel defining an interior panel surface and at least one floor defining an outer edge thereon spatially disposed from the interior wall surface to define a safing slot extending between the interior surface of the interior panel and the outer edge of the floor, wherein the improvement comprises a thermal insulating and sealing means for effectively thermally insulating and sealing of the safing slot comprising:

A. a primary insulation of thermally resistant flexible mineral wool material positioned in the safing slot defined between the outer edge of the floor and the metal interior panel extending over the interior panel surface of the curtain wall construction to thermally insulate and seal the safing slot defined therebetween, said primary insulation including;

(1) an inner primary end surface positioned in abutment with the outer edge of the floor for sealing thereadjacent;

(2) an outer primary end surface positioned in abutment with the metal interior panel extending over the interior surface of the curtain wall construction and unattached to the interior surface of the adjacent metal interior panel;

(3) a lower primary facing surface extending between said inner primary end surface and said outer primary end surface and facing downwardly therebetween;

B. a supplemental insulation of thermally resistant flexible mineral wool material attached to the metal interior panel of the curtain wall construction at a position immediately below said primary insulation and in abutment with said lower primary facing surface thereof, said supplemental insulation being attached to the metal interior panel and extending across the safing slot toward the outer edge of the floor thereadjacent without being attached thereto, said supplemental insulation comprising a band of supplemental insulation extending longitudinally along and in abutment with said lower primary facing surface of said primary insulation, said supplemental insulation being movable along with the metal interior panel of the wall to maintain insulation in abutment therewith and to facilitate maintaining complete insulation across the safing slot;

C. a supplemental attachment means for attaching of said supplemental insulation to the metal interior panel positioned thereadjacent, said supplemental attachment means comprising:

(1) at least one weld pin extending through said supplemental insulation and being attached to the interior panel surface of the metal interior panel;

(2) at least one cap nut secured to each of said pin adjacent said supplemental insulation at a position remotely positioned from the interior surface of the metal interior panel for facilitating attachment of said supplemental insulation to the interior panel surface of the metal interior panel immediately below said primary insulation and in abutment to said lower primary facing surface thereof;

D. a outer fire retardant coating positioned extending across said primary insulation and the adjacent portions of the metal interior panel and the floor located thereadjacent.

* * * * *

UNITED STATES PATENT AND TRADEMARK OFFICE

CERTIFICATE OF CORRECTION

PATENT NO. : 7,856,775 B2
APPLICATION NO. : 12/288072
DATED : December 28, 2010
INVENTOR(S) : Stahl, Jr.

It is certified that error appears in the above-identified patent and that said Letters Patent is hereby corrected as shown below:

In column 9, line 30, delete “means”.

In column 9, line 36, delete “means”.

In column 10, line 23, delete “respect to”.

In column 12, line 23, delete “to”.

In column 12, line 23, after “abutment” insert -- with --.

Signed and Sealed this
Twenty-second Day of March, 2011

David J. Kappos

David J. Kappos
*Director of the United States Patent and Trademark Office*